US007086876B1

(12) United States Patent
Montena

(10) Patent No.: US 7,086,876 B1
(45) Date of Patent: Aug. 8, 2006

(54) COAXIAL CABLE PORT SECURITY DEVICE AND METHOD OF USE THEREOF

(75) Inventor: Noah P. Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/120,409

(22) Filed: May 3, 2005

(51) Int. Cl.
*H01R 13/44* (2006.01)

(52) U.S. Cl. ..... 439/133; 439/304

(58) Field of Classification Search ..... 439/133, 439/304, 321, 394, 623
See application file for complete search history.

(56) References Cited

U.S. PATENT DOCUMENTS 3,953,097 A * 4/1976 Graham ..... 439/307
4,469,386 A * 9/1984 Ackerman ..... 439/133
4,575,274 A * 3/1986 Hayward ..... 403/2
4,793,821 A * 12/1988 Fowler et al. ..... 439/321
4,834,667 A 5/1989 Fowler et al.
5,031,981 A * 7/1991 Peterson ..... 385/56
5,106,312 A * 4/1992 Yeh ..... 439/133
5,145,394 A 9/1992 Hager
5,653,605 A * 8/1997 Woehl et al. ..... 439/321
5,785,545 A * 7/1998 Holt ..... 439/352
6,183,293 B1 2/2001 Kieninger
6,491,546 B1 * 12/2002 Perry ..... 439/620
6,733,338 B1 * 5/2004 Hsia ..... 439/578

* cited by examiner

*Primary Examiner*—Tulsidas C. Patel
*Assistant Examiner*—Vladimir Imas
(74) *Attorney, Agent, or Firm*—Schmeiser, Olsen & Watts

(57) ABSTRACT

A coaxial cable port security device is provided, wherein the port security device comprises a one-way clutch mechanism positioned between a first body and a second body and utilized to prevent unauthorized access to a coaxial cable port unless a specific tool is used to negate the operation of the clutch mechanism and remove the port security device, thereby enabling authorized access to the port.

20 Claims, 6 Drawing Sheets

COAXIAL CABLE PORT SECURITY DEVICE AND METHOD OF USE THEREOF

BACKGROUND OF INVENTION

1. Technical Field

This invention relates generally to the field of coaxial cable port security devices. More particularly, this invention provides for a port security device employing a one-way clutch mechanism and method of use thereof.

2. Related Art

Electromagnetic transmissions are a prevalent mode of information exchange and coaxial cables are commonly utilized as a medium for electromagnetic communications. Coaxial cable interface ports are typically implemented to facilitate the connection of coaxial cables with various electromagnetic communication devices thereby allowing information to be transmitted via the coaxial cables. Often it is desirable to prevent unauthorized reception or transmission of electromagnetic communications by thwarting connection of a coaxial cable to a coaxial cable interface port. The prevention of unauthorized coaxial cable connections is typically effected by the use of coaxial cable port security devices.

Common coaxial cable port security devices require tightening to the port in order to properly block port access and ordinarily the devices employ freely rotating inner/outer component configurations to secure the port against unauthorized device removal. Due to their freely rotating configurations, a special tool is typically required to properly apply tightening forces when installing the port security devices. A common security device installation practice is to finger tighten the security device onto the port simply by applying slight bending or binding loads between the inner and outer components, thus effecting a limited amount of torsional coupling between the components allowing the device to be tightened onto the port a distance of several threads. A conscientious installer would then use the specific tool to proceed with fully and securely tightening the device, making it impossible for simple methods such as binding pressure allow removal. However, many installers do not make the effort to utilize the tool to securely tighten the device, thus leaving the security device vulnerable to unauthorized removal by the same binding means in which is was applied.

Accordingly, there is a need in the field of coaxial cable port security devices for an improved port security device that more effectively prevents unauthorized access to the coaxial cable interface port.

SUMMARY OF INVENTION

The present invention provides an apparatus for use with coaxial cable communications systems that offers improved reliability.

A first general aspect of the invention provides a coaxial cable port security device, said device comprising an outer body, an inner body receivable within at least a portion of the outer body, and a clutch member operable between the outer body and inner body such that axial rotation in a first direction of the clutch member with respect to the inner body is prevented by contact forces resultant in the clutch member due to its operation with the inner body, and wherein the clutch member is freely movable in the opposite second direction of axial rotation with respect to the inner body unless a specific tool is implemented to negate the operation of the clutch member.

A second general aspect of the invention provides a coaxial cable port security device, said device comprising a first body, a second body axially positioned with respect to the first body, and a resilient member radially positioned between the first body and the second body, wherein the resilient member is freely rotationally movable in only one axial direction with respect to both the first body and the second body, and further wherein the resilient member is freely rotationally movable only with respect to the first body in the opposite axial direction because of physical interference between the resilient member and the second body.

A third general aspect of the invention provides a coaxial cable port security device, said device comprising a first body axially positioned with respect to a second body, the second body receivable within at least a portion of the first body, and means for facilitating uni-directional free rotation of the first body with respect to the second body unless a unique instrument is utilized to manipulate rotation.

A fourth general aspect of the invention provides a method of securing a coaxial cable port, said method comprising providing a coaxial cable port security device, the device including a first body, a second body axially positioned with respect to the first body, and a resilient member radially positioned between the first body and the second body, wherein the resilient member is freely rotationally movable in only one axial direction with respect to both the first body and the second body, and further wherein the resilient member is freely rotationally movable only with respect to the first body in the opposite axial direction because of physical interference between the resilient member and the second body. The method further comprises preventing unauthorized connection of a coaxial cable connector to the coaxial cable port through operation of the coaxial cable port security device.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
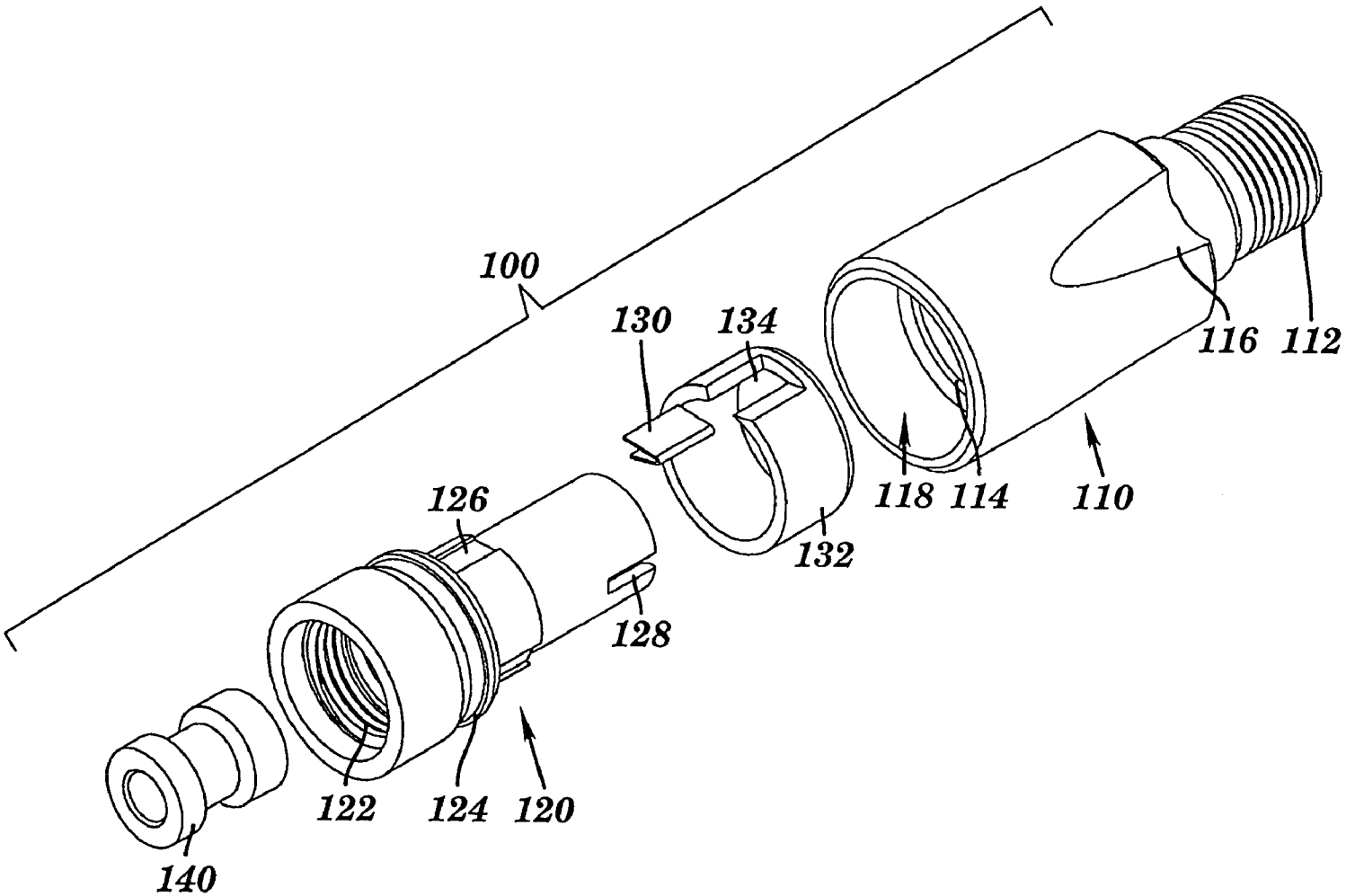
FIG. 1 depicts an exploded perspective view of a first embodiment of a coaxial cable port security device, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts an exploded perspective view of a first embodiment of a coaxial cable port security device 100, in accordance with the present invention. The coaxial cable port security device 100 may include a one-piece first body 110 such as an outer body forming a shell or outer casing. The first body 110 may additionally include a threaded end 112. Moreover, the first body or outer body 110 may include an external grip feature 116 that may assist a user in grasping and maneuvering the coaxial cable port security device 100 during installation onto and/or removal from a coaxial cable port. The external grip feature 116 may be variously dimensioned to efficiently accommodate physical grip on the coaxial cable port security device 100. Multiple external grip features 116 may be included on the first embodiment of the coaxial cable port security device 100. Furthermore, the first body 110 such as an outer body may include an internal retaining feature 114 such as an annular recess, inner circumferential slot, or other like feature fitted to achieve retention of a second body 120 such as an inner body received within an insert opening 118 of the first body or outer body 110. Accordingly, when the second body or inner body 120 is received within a portion of the first body 110 an external retaining feature 124 of the second body 120 may be in communication with the internal retaining feature 114 of the first body 110 such as an outer body. Contact between the first body 110 and the second body 120 should not substantially impede axial rotation of the two bodies with respect to each other.

The second body 120, as shown further in FIG. 1, may be axially positioned with respect to the first body 110. Moreover, the second body 120 such as an inner body may also include a threaded opening 122 configured to attach to a coaxial cable interface port. Additionally, the second body 120 may include a clutch engagement feature 126. The clutch engagement feature 126 may be a slot, cutout, detent, ridge, recess, protrusion or other like feature that slidingly contacts a resilient clutch member 130 when the member 130 is rotated about the second body 122 such as an inner body in one first axial direction and, wherein the clutch engagement feature 126 helps prohibit movement of the resilient clutch member 130 when the member 130 is moved in the second opposite axial direction because of physical interference between the resilient clutch member 130 and the clutch engagement feature 126 of the second body 120. Those in the art will appreciate that more than one clutch engagement feature 126 may be incorporated in the design of the second body 120. For example, multiple clutch engagement features 126 may be spaced at intervals around the annular exterior of the second body 120 such as an inner body thereby allowing a resilient clutch member 130 to more frequently contact and/or engage a clutch engagement feature 126 as the resilient clutch member 130 rotates about the second body or inner body 120. Furthermore, the second body 120 may include a tool engagement feature 128. The tool engagement feature 128 may be variously configured to physically and dimensionally correspond with an engagement element and/or elements 308 of a special tool or instrument 300 (shown in FIGS. 5–6) to assist the specific tool or instrument 300 in engaging the second body 120.

Referring further to FIG. 1, an embodiment of a coaxial cable port security device 100 may include a positioning ring 132 acting with a resilient clutch member 130. An embodiment of the positioning ring 132 may include a clutch seat 134, such as a notch, slot, cutout, recess or other like feature physically corresponding in size and dimension to the size and dimension of the resilient clutch member 130 for positioning the resilient clutch member 130 radially between the first body 110 such as an outer body and second body 120 such as an inner body. The positioning ring 132 may be freely rotatable with respect to the first body 110 and second body 120. Hence the resilient clutch member's 130 active position with the ring 132 provides for substantially consistent axial and radial positioning when rotatably operating with the first body 110 such as an outer body and/or second body 120 such as an inner body. It is appreciable within the art that various embodiments of a coaxial cable port security device 100 may include multiple resilient clutch members 130 radially positioned between the first body 110 and second body 120, thereby allowing the multiple resilient clutch members 130 to more frequently contact and/or engage a clutch engagement feature 126 as the resilient clutch members 130 rotate about the second body 120 such as an inner body.

Operation of a resilient clutch member 130 may include slidable physical contact by the resilient clutch member 130 with an interior surface of the first body 110 such as an outer body when the resilient clutch member is axially rotated in either axial direction. Moreover, operation of the resilient clutch member 130 may also include slidable physical contact by the resilient clutch member 130 with an exterior surface of the second body 120 such as an inner body when the resilient clutch member 130 is rotated in a first axial direction because the shape and function of the resilient clutch member 130 does not prevent rotation. However, when rotated in the second opposite axial direction, the resilient clutch member 130 is only freely rotationally movable with respect to the first body or outer body 110 because of contact forces resultant in the resilient clutch member 130 due to its operation with the second body or inner body 120, wherein physical interference between the resilient clutch member 130 and the clutch engagement feature 126 of the second body 120 prevents free rotation in the second opposite axial direction.

Referring further still to FIG. 1, an embodiment of a coaxial cable port security device 100 may include a center bushing 140, axially alignable with the first body 110, second body 120 and/or positioning ring 132. The variously embodied components of the first embodiment of a coaxial cable port security device 100 may be fabricated from metals, metal alloys, composites or semi-rigid plastics by turning, milling, tapping, boring, stamping, bending, cutting, injection molding, casting, and/or other like part shaping techniques. Furthermore, those in the art should recognize that various features of components of the coaxial cable port security device 100 may be reciprocally oriented in various ways without destroying the inventive nature of the device 100. For example, the first body 110 such as an outer body may include protruding internal retaining features 114 as opposed to recessed internal retaining features and the second body 120 such as an inner body may include recessed external retaining features 124 as opposed to protruding external retaining features and the reciprocal feature designs of first body 110 and second body 120 would effectively accomplish coaxial cable port protection.

Central to the performance of the coaxial cable port security device 100 is the prevention of unauthorized port access by means of employing the resilient clutch member 130 to help facilitate uni-directional rotation of the first body 110 such as an outer body with respect to the second body 120 such as an inner body. Because the resilient clutch member 130 is positioned between the first body 110 and the second body 130, the resilient clutch member 130 alleviates common vulnerabilities caused by binding forces between the two bodies. Where binding forces between the first body 110 and the second body 120 permitted previous security devices to be unthreaded from a port leaving the port unprotected and available for unauthorized cable connection, embodiments of the present invention use the resilient clutch member 130 as means to facilitate free rotation of the first body 110 such as an outer body with respect to the second body 120 such as an inner body unless a unique instrument or tool 300 (shown in FIGS. 5–6) is utilized to manipulate rotation. Once installed, the coaxial cable port security device spins freely in a first loosening direction of rotation. The resilient clutch member 130 engages the second body or inner body 120 in only a second tightening direction of rotation when binding forces are applied and/or when torque is applied to the outer component in a tightening direction. Hence, an unauthorized user cannot remove the coaxial cable port security device 100 by applying binding forces between the components. However, an installer can still attach the coaxial cable port security device 100 to a coaxial cable port by applying binding torque to the first body or outer body 110 in the tightening direction, thus engaging the resilient clutch member 130 with the second body or inner body 120 and allowing the installer to twist the device onto the port a distance of several threads. A conscientious installer would then utilize the special tool 300 (shown in FIGS. 5–6) to proceed with fully and securely tightening the security device 100 to the port. However, if the device 100 is left merely finger installed and not fully tightened through utilization of the tool 300, the device 100 still may provide port security because the operation of the resilient clutch member 130 prevents rotational engagement of the second body 120 when rotated in the loosening direction.

Figure 2:
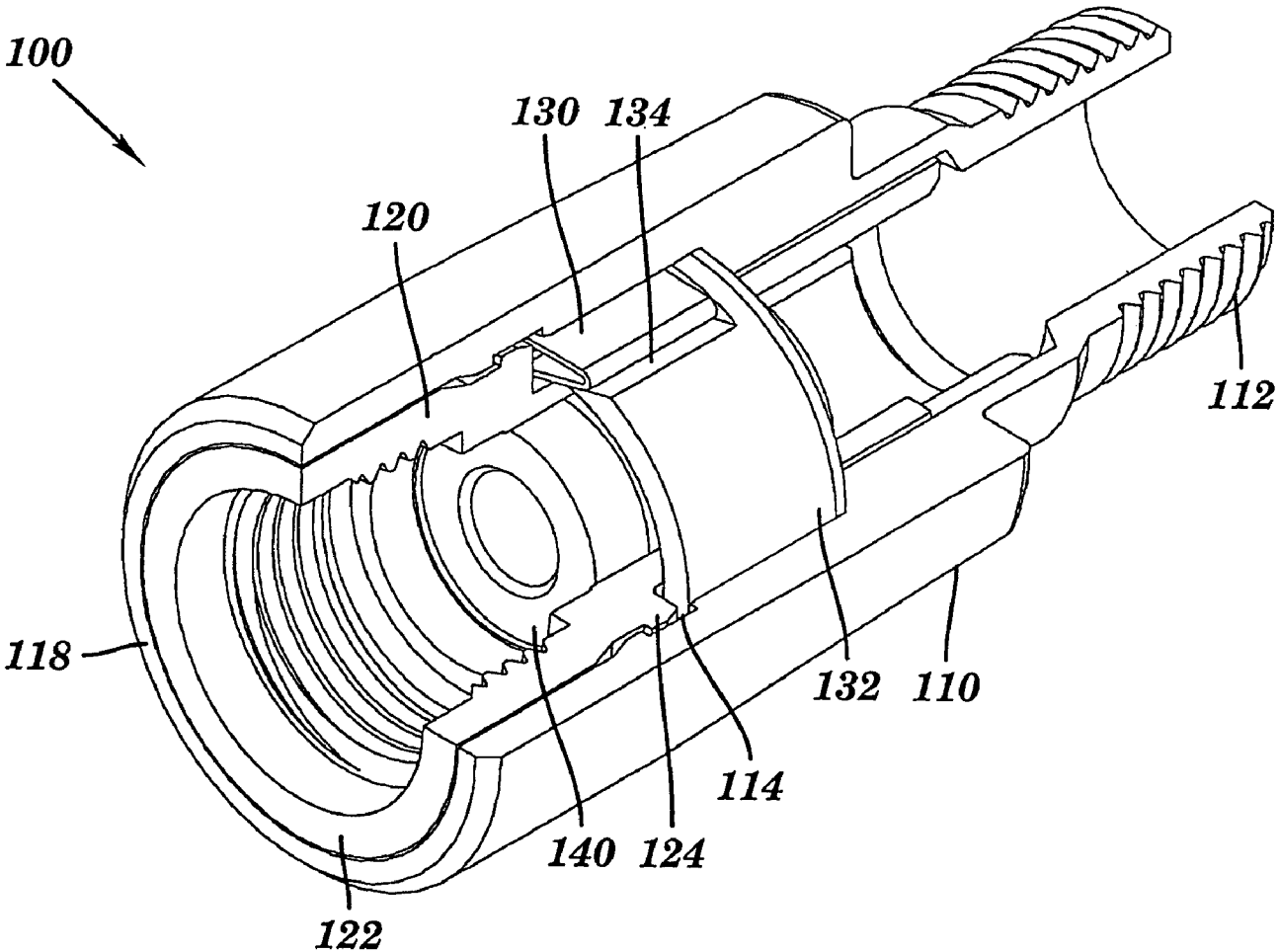
FIG. 2 depicts a cut-away perspective view of a first embodiment of a coaxial cable port security device, in accordance with the present invention.

With further reference to the drawings, FIG. 2 depicts a cut-away perspective view of a first embodiment of a coaxial cable port security device 100, in accordance with the present invention. When fully assembled, the second body or inner body 120 may be received within a portion of the first body or outer body 110 such that the edge of the threaded opening 122 of the second body 120 such as an inner body is flush with the edge of the insert opening 118 of the first body 110 such as an outer body. Moreover, when fully assembled the first body 110 is axial retained in substantially fixed position with respect to the second body 120 due to communication between the parts. For example, when fully inserted, the external retaining feature 124, such as an annular lip, of the second body 120 such as an inner body may snap-fit into place with the internal retaining feature 114, such as an annular rim, of the first body 110 such as an outer body, thereby maintaining axial position of the two parts with respect to each other. However, the two parts may remain rotationally free with respect to each other in that the resilient clutch member 130 and/or the positioning ring located between the parts may operate to help facilitate slidable axial rotational movement of the first body 110 with respect to the second body 120. The resilient clutch member 130 may be retained in position within the first embodiment of the coaxial cable port security device 100 by the presence of the first body or outer body 110 encasing the radial exterior portion of the resilient member 130 as located in the clutch seat 134 of the retaining ring 132 when assembled with the second body or inner body 120 physically enclosing the radial interior portion of the resilient member 130.

With continued reference to FIG. 2, an embodiment of the coaxial cable port security system 100 may include a center bushing 140 located within a hollowed portion of the second body 120 and positioned centrally along the axis of the coaxial cable port security device 100. Moreover, the first body 110 of the coaxial cable port security device 100 may include a threaded end 112 configured to receive additional complimentary threaded components such as end caps or other threaded parts and/or configured to facilitate attachment of the coaxial cable port device to additional parts having complimentary threaded interior openings.

Figure 3:
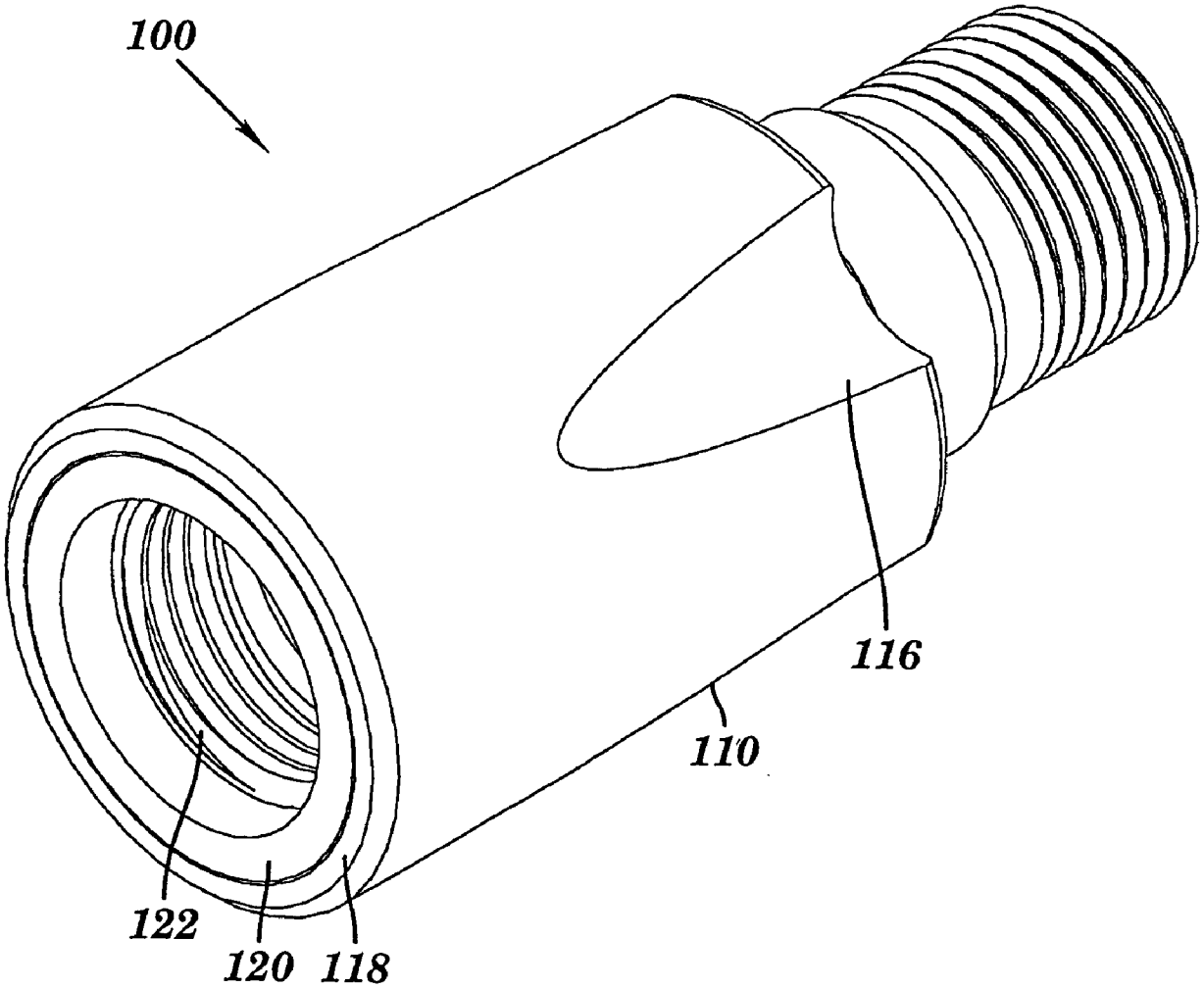
FIG. 3 depicts a perspective view of a first embodiment of a coaxial cable port security device, in accordance with the present invention.

Referring still further to the drawings, FIG. 3 depicts a perspective view of a first embodiment of a coaxial cable port security device 100, in accordance with the present invention. Shown, on the exterior of the first body or outer body 110, is an external grip feature 116 that may be utilized by a user installing the security device 110 to assist in rotating the device 100 by providing an effective gripping surface to enable greater application of torque. Furthermore, where the edge of the threaded opening 122 of the second body 120 such as an inner body is flush with the edge of the insert opening 118 of the first body 110 such as an outer body, greater port protection may be afforded because the second or inner body 120 cannot be efficiently accessed separately from the first or outer body 110 to manipulate unauthorized removal of the security device 100.

Figure 4:
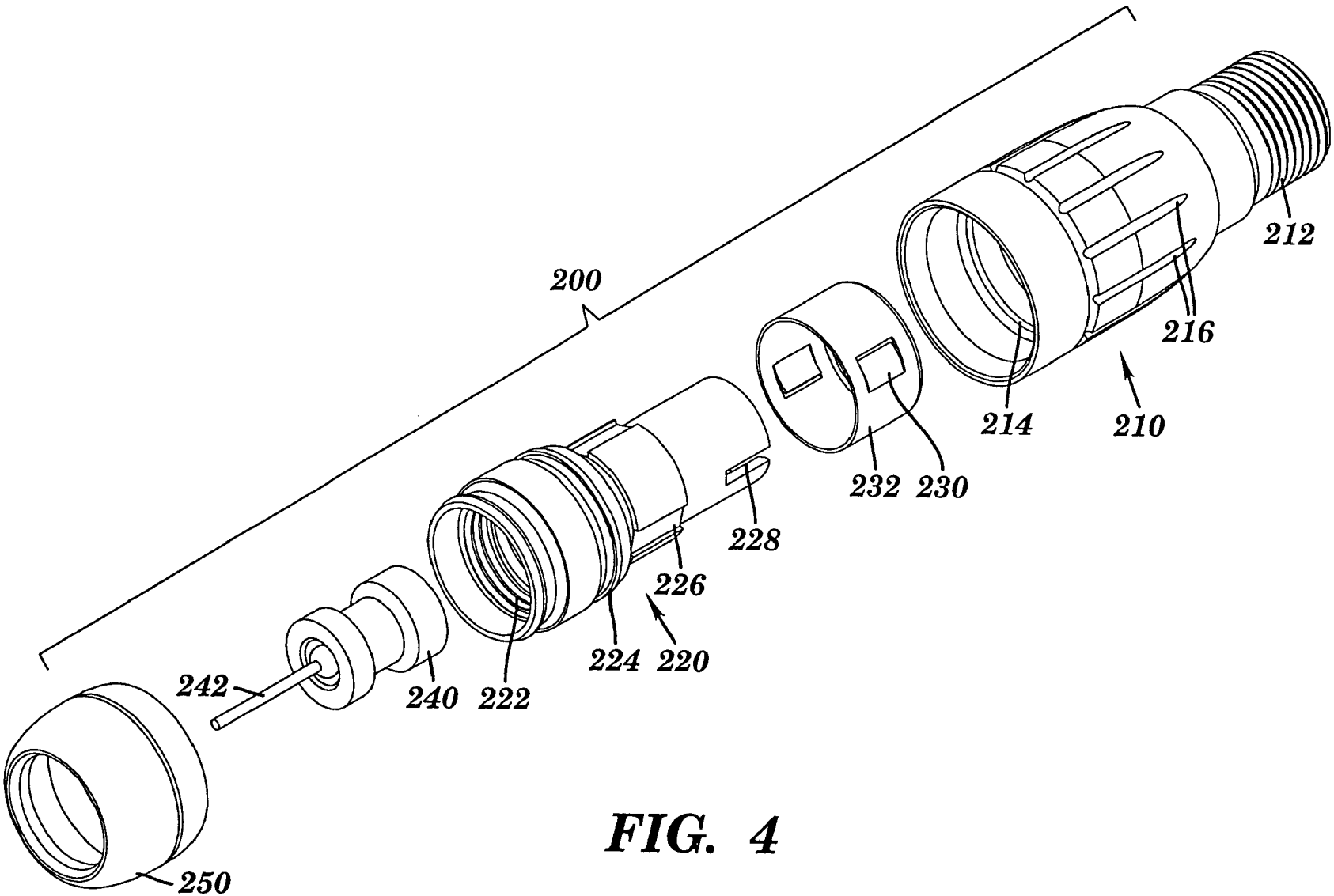
FIG. 4 depicts an exploded perspective view of a second embodiment of a coaxial cable port security device, in accordance with the present invention.

With additional reference to the drawings, FIG. 4 depicts an exploded perspective view of a second embodiment of a coaxial cable port security device, in accordance with the present invention. The coaxial cable port security device 200 may include a first body 210 such as an outer body forming an external rigid sleeve or covering. The first body 210 may also include a threaded end 212. Moreover, the first body or outer body 210 may include multiple external grip features 216 that may assist a user in grasping and maneuvering the coaxial cable port security device 200 during installation onto and/or removal from a coaxial cable port. The external grip features 216 may be variously dimensioned to efficiently accommodate physical grip on the coaxial cable port security device 200. Furthermore, the first body 210 such as an outer body may include an internal retaining feature 214 such as an annular recess, inner circumferential slot, or other like feature fitted to achieve retention of a second body 220 such as an inner body received within an insert opening 218 of the first body or outer body 210. Accordingly, when the second body or inner body 220 is received within a portion of the first body 210 such as an outer body an external retaining feature 224 of the second body 220 may be in communication with the internal retaining feature 214 of the first body 210. Contact between the first body 210 and the second body 220 should not substantially impede axial rotation of the two bodies with respect to each other.

The second body 220 may also have a threaded opening 222 configured to attach to a coaxial cable interface port. Moreover, the second body 220 may be axially positioned with respect to the first body 210. Additionally, the second body 220 may include a clutch engagement feature 226 such as a slot, cutout, detent, ridge, recess, protrusion or other like feature that slidingly contacts a resilient clutch member 230 when the member 230 is rotated about the second body 220 such as an inner body in one first axial direction and, wherein the clutch engagement feature 226 helps prohibit movement of the resilient clutch member 230 when the member 230 is moved in the second opposite axial direction because of physical interference between the resilient clutch member 230 and the clutch engagement feature 226 of the second body 220. Those in the art will appreciate that more than one clutch engagement feature 226 may be incorporated in the design of the second body 220. Furthermore, the second body 220 may include a tool engagement feature 228. The tool engagement feature 228 may be variously configured to physically and dimensionally correspond with an engagement element and/or elements 308 of a specific tool or instrument 300 (shown in FIGS. 5–6) to assist the specific tool or instrument 300 in engaging the second body 220. It may be recognizable by those skilled in the relevant art that embodiments of the coaxial cable port security device 200 may include multiple tool engagement features 228 to facilitate further interaction and greater engagement with a specific tool or instrument 300 to fully tighten the device 200 to a coaxial cable interface port.

Referring further to FIG. 4, an embodiment of a coaxial cable port security device 200 may include a positioning ring 232 acting with an integral resilient clutch member 230. The integral resilient clutch member 230 may be a flexible portion or segment bent radially inward from the body of the positioning ring 232. Because the resilient clutch member 230 may be integral with the positioning ring 232, the manufacture of the components can be integrated and the parts consolidated while maintaining the individual functionality of each component element. For example, the resilient clutch member 230 can be fashioned from the ring 232 by an automated stamping, punching or cutting process or other like method of fabrication. Moreover, where the resilient clutch member 230 is integrally attached to the positioning ring 232, assembly is made more efficient because the components can be placed in an assembled position in the coaxial cable port security device 200 simultaneously without the need to separately accommodate the resilient clutch member 230 with the positioning ring 232, such as by locating the clutch member 230 within a clutch seat 134 (as depicted in FIG. 1, showing a first embodiment of a coaxial cable port security device 100). The resilient clutch member's 230 integral and active residence with the ring 232 provides for substantially consistent axial and radial positioning when rotatably operating with the first body 210 such as an outer body and/or second body 220 such as an inner body. As shown, the second embodiment of the coaxial cable port security device 200 may have multiple resilient clutch members 230 integrated with the positioning ring 232 and radially positioned between the first body 210 and second body 220, thereby allowing the multiple resilient clutch members 230 to more frequently contact and/or engage a clutch engagement feature 226 as the resilient clutch members 230 rotate about the second body 220 such as an inner body.

Operation of an integral resilient clutch member 230 may include slidable physical contact by the integral resilient clutch member 230 with an exterior surface of the second body 220 such as an inner body when the integral resilient clutch member 230 is rotated in a first axial direction because the shape and function of the integral resilient clutch member 230 does not frustrate rotation. However, when rotated in the second opposite axial direction, the integral resilient clutch member 230 is not freely rotationally movable with respect to the second body 210 because of contact forces resultant in the integral resilient clutch member 230 due to its operation with the second body 220, and wherein physical interference between the integral resilient clutch member 230 and a clutch engagement feature 226 of the second body 220 prevents free rotation in the second opposite axial direction.

With further reference to FIG. 4, an embodiment of a coaxial cable port security device 200 may include a center bushing 240, axially alignable with the first body 210, second body 220 and/or positioning ring 232. Furthermore, the coaxial cable port security device 200 may include a center pin 242 adaptable for insertion within a portion of the center bushing 240. The center pin 242 may also be insertable into a central axial opening commonly located in typical coaxial cable interface ports. In addition, the second embodiment of the coaxial cable port security device 200 may include an environmental cap 250. The environmental cap 250 may be configured to fit between the internal edge of the insert opening 218 of the first body 110 such as an outer body and the external edge of the threaded opening 222 of the second body 220 such as an inner body to prevent moisture or other unwanted contaminants from entering the port security device 200, or even act to prevent entry of unwanted electromagnetic noise into the port security device 200. The fit of the environmental cap 250 may be a snap-fit, press-on type design, or other similar configuration wherein various surface features may be employed to physically restrain and help hold the cap 250 in place once it is positioned with the coaxial cable port security device 200.

Those in the art should recognize that various features of components of the second embodiment of the coaxial cable port security device 200 may be reciprocally oriented in various complimentary ways without destroying the inventive nature of the device 200. For example, the environmental cap 250 may be configured to extend over the external edge insert opening 218 of the first body or outer body 210 rather than being fitted between the internal edge of the insert opening 218 of the first body and the external edge of the threaded opening 222 of the second body 220. Moreover, the first body 210 such as an outer body may include protruding internal retaining features 214 as opposed to recessed internal retaining features and the second body 220 such as an inner body may include recessed external retaining features 224 as opposed to protruding external retaining features and the reciprocal feature designs of first or outer body 210 and second or inner body 220 would effectively accomplish coaxial cable port protection. Additionally, the various components of the second embodiment of a coaxial cable port security device 200 may be fabricated from metals, metal alloys, composites or semi-rigid plastics by turning, milling, tapping, boring, stamping, punching, bending, cutting, injection molding, casting, and/or other like part shaping techniques.

When a second embodiment of the coaxial cable port security device 200 is installed on a typical cable interface port, the coaxial cable port security device 200 may spin freely in a first loosening direction of rotation. However, the integral resilient clutch member 230 may only engage the second body 220 for operable rotation in a second tightening direction of rotation when binding forces are applied and/or when torque is applied to the first body 210 in a tightening direction. Hence, an unauthorized user cannot remove the coaxial cable port security device 200 by utilizing binding forces between the first body 210 and second body 220. However, an installer can still attach embodiments of the coaxial cable port security device 200 to a coaxial cable port by applying binding torque to the first body 210 in the tightening direction, thus engaging the integral resilient clutch member 230 with the clutch engagement feature 226 of the second body 220 and allowing the installer to twist the device 200 onto the interface port a distance of several threads. A thorough installer would also utilize a specific tool 300 (shown in FIGS. 5–6) to proceed with fully and securely tightening the security device 200 to the port. However, if the installer neglects to use the special tool 300 to fully tighten the device 200 onto the port and instead merely finger tightens the device 200 onto the port, the device 200 still may provide port security because the operation of the integral resilient clutch member 230 prevents rotational engagement of the second body 220 to loosen the device 200 and allow open connectivity with the port.

Figure 5:
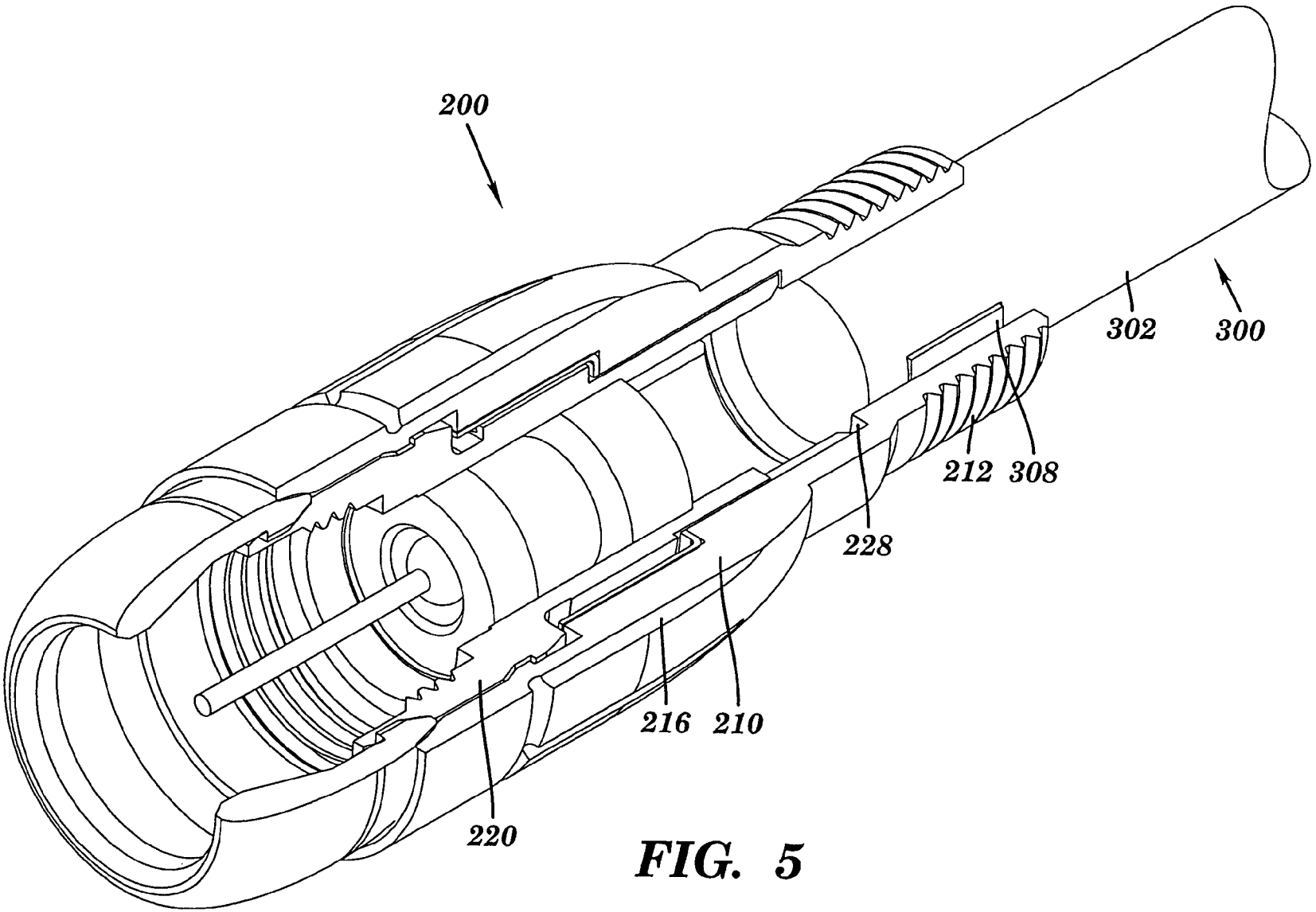
FIG. 5 depicts a cut-away perspective view of a second embodiment of a coaxial cable port security device being initially engaged by an embodiment of a specific tool, in accordance with the present invention.

With further reference to the drawings, FIG. 5 depicts a cut-away perspective view of a second embodiment of a coaxial cable port security device 200 being initially engaged by an embodiment of a specific tool 300, in accordance with the present invention. The specific instrument or tool 300 may include a shaft member 302 being dimensionally configured to be axially inserted into the coaxial cable port security device 200 at the threaded end 212 of the first body 210 of the device 200. Additionally, the special tool or instrument 300 may include an engagement element 308. The engagement element 308 may be a retractable protrusion geometrically configured to correspond in size and shape to the tool engagement feature 228 of the second body 220 of the port security device 200. When protruding from the shaft member 302 of the special tool or instrument 300, the engagement element 308 may extend beyond the radial dimension of the internal edge of the threaded end 212. Hence, the tool may not be efficiently insertable into the security device 200 unless the engagement element 308 is retracted because, while protruding, the feature 308 obstructs tool 300 insertability due to physical interference with the threaded end 212 of the first body 210 of the coaxial cable port security device 200.

Engagement of the specific tool or instrument 300 with the coaxial cable port security device 200 may be accomplished by a user may grasping the exterior of the security device 200, the user's grasp possibly being assisted by the external gripping features 216 of the device 200. While grasping the device, the user may initially retract the engagement element 308 of the special tool or instrument 300 so that the shaft member of the tool 300 may be inserted into the port security device 300 unobstructed by the protruding engagement element 308. It should be appreciated that the special and specific tool or instrument 300 may include multiple engagement elements 308 corresponding to the number of tool engagement features 228 appertaining to the physical configuration of the second body 220 of the coaxial cable port security device 200. The multiple engagement elements 308 may be positioned on the special tool or instrument 300 in a complimentary dimensional arraignment so as to engage the corresponding multiple tool engagement features 228 of the port security device 200.

Figure 6:
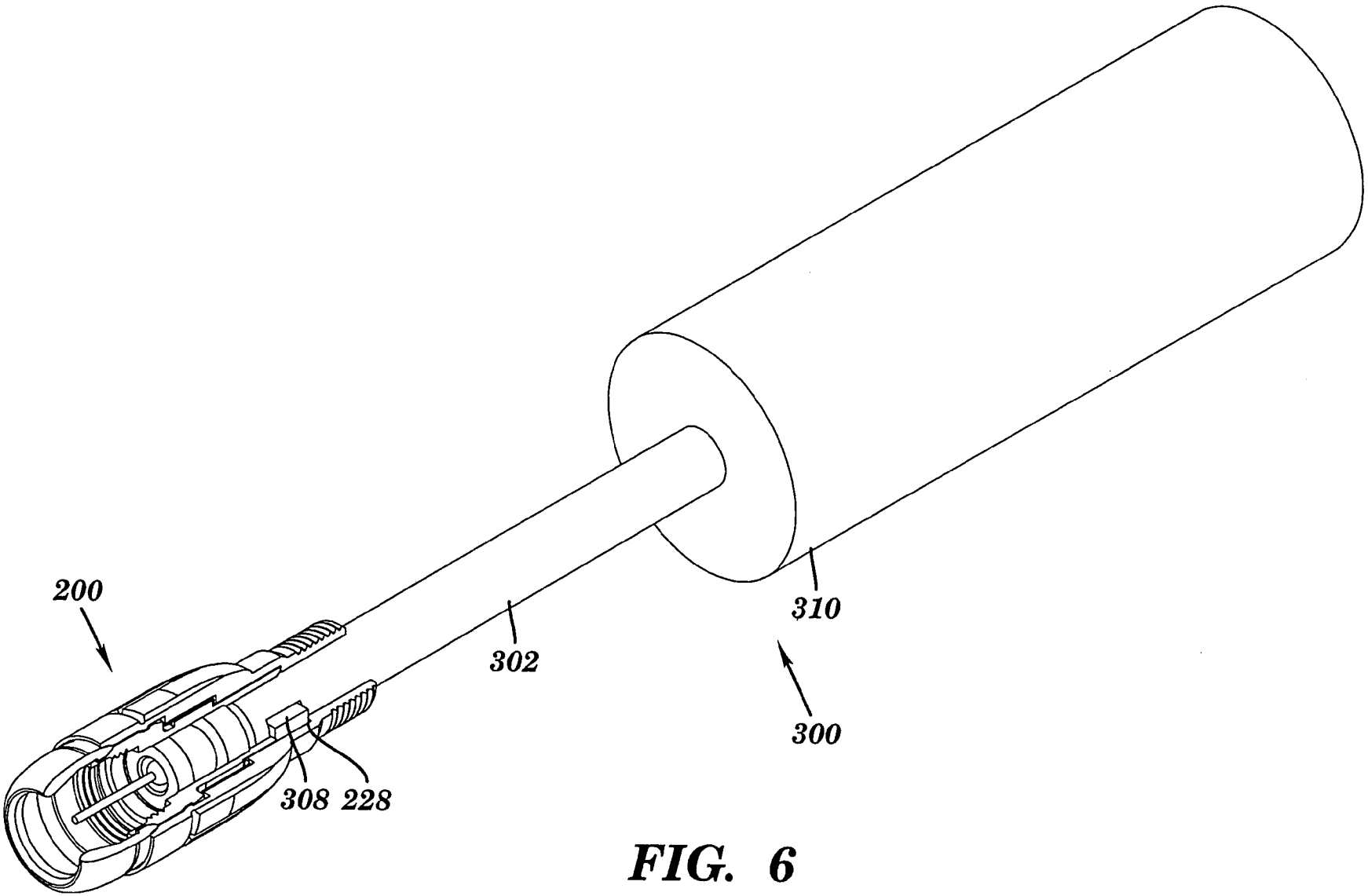
FIG. 6 depicts a cut-away perspective view of a second embodiment of a coaxial cable port security device being fully engaged by an embodiment of a specific tool, in accordance with the present invention.

Referring even further still to the drawings, FIG. 6 depicts a cut-away perspective view of a second embodiment of a coaxial cable port security device 200 being fully engaged by an embodiment of a specific tool 300, in accordance with the present invention. The special tool or instrument 300 may include a handle body portion 310, which may be configured to facilitate retraction of the engagement element 308 as operated by a user. For example, the user may twist the handle body 310 portion of the tool 300 in relation to the shaft member 302 portion of the tool thereby effectuating a screw-type extension maneuver of the engagement element 308. It is recognizable that other instrumentalities and configurations may also be employed to accomplish the retractable operation of the engagement element 308 of the tool 300. When the shaft member 302 of the specific tool or instrument 300 is inserted axially within the coaxial cable port security device 200 to a point where the engagement element 308 geometrically aligns position with the tool engagement feature 228 of the security device 200, then the engagement element 308 of the tool 300 may extend into mechanical communication with the tool engagement feature 228 of the coaxial cable port security device 200. Once mechanically engaged, the tool may operate to negate the security operation of the integral resilient clutch member 230 (shown in FIG. 4). The negation may be effected because the mechanical engagement of the tool 300 with the security device 200, allows a user wielding the tool 300 to manipulate the second body 220 of the security device 200 in a loosening rotational direction regardless of the free spinning action facilitated by operation of the integral resilient clutch member 230. Hence a user could use the unique tool 300 to loosen and unthread the coaxial cable port security device 200 from the coaxial cable interface port the device 200 was protecting. Furthermore, a user may also utilize the specific tool or instrument 300 to fully tighten and thread the coaxial cable port security device 200 onto a coaxial cable interface port because the mechanical engagement of the tool 300 with the device 200 and the gripping ability provided by the handle body 310 of the tool 300, allow a user to generate larger tightening torque than mere finger tightening.

Coaxial cable port security may be achieved in some measure through limitation of unauthorized port access. Embodiments (such as security device 100 and security device 200 and/or other like embodiments) of the coaxial cable port security device described herein may utilize a specific tool 300 to loosen the security device 200. Those in the art will appreciate that limited and controlled distribution of such special tools to only authorized installers will greatly assist in the protective functionality of the presently described coaxial cable port security device 200. Because of the operation of the coaxial cable port security device 200, attempts to remove the security device 200 may be futile without the special tool 300. The coaxial cable interface port may therefore remain protected regardless of whether the inventive security device 200 was fully tightened onto the port during installation of the device 200.

A method of securing a coaxial cable port is now described with reference to FIG. 4. The port security method may include providing a coaxial cable port security device 200. The provided coaxial cable port security device 200 may include a first body 210 and a second body 220 axially positioned with respect to the first body 210. Moreover, the provided coaxial cable port security device 200 may include a resilient member 230 radially positioned between the first body 210 and the second body 220. The resilient member 230 may be freely rotationally movable in only one axial direction with respect to both the first body 210 and the second body 220. Furthermore, the resilient member may be freely rotationally movable only with respect to the first body in the opposite axial direction because of physical interference between the resilient member 230 and the second body 220. The method of protecting a coaxial cable port may also include preventing unauthorized connection of a coaxial cable to the coaxial cable interface port through operation of the coaxial cable port security device 200

With further reference to FIG. 4 and additional reference to FIGS. 5–6, continued depiction of a method of securing a coaxial cable port is laid forth. The prevention of unauthorized connection of a coaxial cable to the interface port may involve the uni-directional operability of the coaxial cable port security device 200 as facilitated by the one-way functionality of the resilient clutch member 230. The resilient clutch member 230 may function to allow physical engagement of the second body 230 such as an inner body when binding forces between the components and/or torque is applied to the first body 210 such as an outer body to rotate the coaxial cable port security device in a tightening direction. Thus, the threaded opening 222 of the second body 220 may be finger-tightened onto a coaxial cable interface port a distance of several threads. However, when rotated in the opposite direction, the resilient clutch member 230 spins freely without substantially engaging the second body 220, thereby prohibiting the port security device 200 from being unthreaded and/or removed from an interface port.

Authorized connection of a coaxial cable to the interface port may be achieved by utilizing a specific tool or instrument 300 to engage the coaxial cable port security device in a loosening rotational direction to directly unthread the second body 220 and negate the free spinning security operation of the resilient clutch member 230. Furthermore, an authorized installer may utilize the special tool 300 to more fully and securely tighten the coaxial cable port security device 200 onto an interface port by applying greater tightening torque obtained through mechanical advantage realized through operation of the unique tool 300.

Further methodology for providing coaxial cable port security may include, providing a first embodiment of a coaxial cable port security device 100 or other like embodiments of a coaxial cable port security device in accordance with the present invention. Moreover, those in the art will appreciate that preventing unauthorized connection of a coaxial cable to a coaxial cable port may be accomplished through operation of the first embodiment of a coaxial cable port security device 100 or other like embodiments of a coaxial cable port security device in accordance with the present invention.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A coaxial cable port security device, said device comprising:

a one-piece outer body;

an inner body, receivable within at least a portion of the one-piece outer body, wherein the one-piece outer body shields the inner body from exterior access when the inner body is received by the outer body and when said inner body is attached to the coaxial cable port; and a clutch member operable between the one-piece outer body and inner body such that axial rotation in a first direction of the clutch member with respect to the inner body is prevented by contact forces resultant in the clutch member due to its operation with the inner body, and wherein the clutch member is configured to prevent detachment of the inner body from the coaxial cable port.

2. The coaxial cable port security device of claim 1, said device further comprising a positioning ring.

3. The coaxial cable port security device of claim 1, said device further comprising a center bushing.

4. The coaxial cable port security device of claim 1, said device further comprising an environmental cap.

5. The coaxial cable port security device of claim 1, said device further comprising a center pin.

6. The coaxial cable port security device of claim 1, said device further comprising at least one tool engagement feature configured on the inner body for assisting in the operable engagement of the specific tool with the coaxial cable port security device.

7. The coaxial cable port security device of claim 6, wherein the specific tool includes at least one retractable engagement element corresponding to the at least one tool engagement feature of the inner body.

8. A coaxial cable port security device, said device comprising:

a one-piece first body;

a second body, having a threaded opening for mounting to the coaxial cable port, said second body axially positioned with respect to the one-piece first body such that the one-piece first body shields the second body from exterior access when the second body is mounted on the coaxial cable port; and a resilient member radially positioned between the one-piece first body and the second body, wherein the resilient member is freely rotationally movable in both directions about an axis with respect to the one-piece first body and in only one direction about an axis with respect to the second body because of physical interference between the resilient member and the second body.

9. The coaxial cable port security device of claim 8, said device further comprising a positioning ring.

10. The coaxial cable port security device of claim 8, said device further comprising a center bushing.

11. The coaxial cable port security device of claim 8, said device further comprising an environmental cap.

12. The coaxial cable port security device of claim 8, said device further comprising a center pin.

13. The coaxial cable port security device of claim 8, said device being operable with a special instrument.

14. The coaxial cable port security device of claim 13, said device further comprising at least one tool engagement feature configured on the second body for facilitating operation of the special instrument with the coaxial cable port security device.

15. The coaxial cable port security device of claim 14, wherein the special instrument includes at least one retractable engagement element corresponding to the at least one tool engagement feature of the second body.

16. A coaxial cable port security device, said device comprising:

a first one-piece body axially positioned for rotation with respect to a second body, said one-piece first body configured to shield the second body from exterior access when the second body is received within at least a portion of the one-piece first body and attached to the coaxial cable port; and means for facilitating uni-directional rotation of the second body with respect to the coaxial cable port as manipulated by a unique instrument.

17. The coaxial cable port security device of claim 16, said device further comprising tool engagement means for assisting in the operable engagement of the unique instrument with the coaxial cable port security device.

18. The coaxial cable port security device of claim 17, wherein the specific tool includes engagement means corresponding to the engagement means of the coaxial cable port security device.

19. A method of securing a coaxial cable port, said method comprising:

providing a coaxial cable port security device, the device including:

a one-piece first body, configured to receive and shield a second body when the second body is attached to the coaxial cable port; and a resilient member radially positioned between the one-piece first body and the second body, wherein the resilient member is rotationally movable in both directions with respect to the one-piece first body and in only one direction with respect to the second body, because of physical interference between the resilient member and the second body; and preventing unauthorized connection of a coaxial cable to the coaxial cable port through operation of the coaxial cable port security device.

20. The method of claim 19 further comprising using a special tool to facilitate authorized connection of a coaxial cable to the coaxial cable port.

* * * * *